United States Patent [19]

Davison

[11] Patent Number: 4,973,286

[45] Date of Patent: Nov. 27, 1990

[54] MULTIPLE ACTIVATION CRIB TOY

[75] Inventor: Anna Davison, Long Beach, Calif.

[73] Assignee: Mattel, Inc., Hawthorne, Calif.

[21] Appl. No.: 498,885

[22] Filed: Mar. 26, 1990

[51] Int. Cl.[5] ..... A63H 30/00; A63H 5/00

[52] U.S. Cl. ..... 446/175; 446/227

[58] Field of Search ..... 446/175, 227, 357, 358, 446/83, 297, 397; 40/457, 455, 414

[56] References Cited

U.S. PATENT DOCUMENTS

| | | | |
|---|---|---|---|
| 937,780 | 10/1909 | Eastman . | |
| 3,036,404 | 5/1962 | Berger | 446/175 |
| 3,119,201 | 1/1964 | Brown et al. | 446/175 |
| 3,614,840 | 10/1971 | Vadell . | |
| 4,028,843 | 6/1977 | Appel | 446/227 |
| 4,085,542 | 4/1978 | Mitamura | 446/175 |
| 4,230,317 | 10/1980 | Breslow et al. | 446/175 X |
| 4,285,159 | 8/1981 | Bass et al. | 446/227 |
| 4,453,439 | 6/1984 | Koike . | |
| 4,551,114 | 11/1985 | Hyman et al. | 446/227 X |
| 4,600,399 | 7/1986 | Abe | 446/227 X |
| 4,637,007 | 1/1987 | Sakurai | 446/175 X |
| 4,640,034 | 2/1987 | Zisholtz | 446/227 X |
| 4,664,640 | 5/1987 | Shindo et al. | 446/227 |
| 4,717,364 | 1/1988 | Furukawa | 446/175 |

FOREIGN PATENT DOCUMENTS

| | | | |
|---|---|---|---|
| 526243 | 12/1957 | Italy | 446/357 |

*Primary Examiner*—Mickey Yu

*Attorney, Agent, or Firm*—Roy A. Ekstrand

[57] ABSTRACT

A multiple actuation crib toy includes a housing together with a clamp to secure the housing to a convenient surface or portion of an infant crib. An internal circuit within the crib toy produces a musical output and provides predetermined motions of a plurality of activated cartoon-like figures. Noise producing apparatus are also supported upon the toy housing and a microphone is coupled to the music producing circuit such that the sounds produced by the noise producing apparatus of the toy also trigger the musical output of the crib toy.

7 Claims, 3 Drawing Sheets

MULTIPLE ACTIVATION CRIB TOY

FIELD OF THE INVENTION

This invention relates generally to infant toys and particularly to those supported within or upon the crib environment.

BACKGROUND OF THE INVENTION

Through the years, many different types of toys have been developed for entertainment and amusement of human infants and babies. Such toys have assumed a variety of configurations and designs. Certain types of such infant toys are configured to be mounted to or supported by the infant's crib in order to provide entertainment and amusement of the infant within the crib environment. In recent years, an increased emphasis has arisen regarding such crib toys which exhibits a preference for crib toys which simultaneously provide entertainment or amusement value to occupy the child's attention within the crib environment and to provide developmental capabilities. The latter are directed primarily to increasing the infant's responsiveness to sight and sound as well as aiding in the development of manual dexterity skills. Thus, the preferred crib toys are those which simultaneously provide amusement and entertainment together with developmental and functional capability. To meet this need, practitioners in the art have developed a substantial number of crib toys which have assumed an almost endless variety of sizes, shapes and activities.

U.S. Pat. No. 4,285,159 issued to Bass, et al. sets forth a DIRECTION REVERSING CRIB TOY in which a crib toy is configured to replicate a fanciful locomotive and includes an outer housing defining an internal downwardly facing U-shaped channel therethrough. The channel is intended to receive the top rail of the toy crib and support the toy thereon. Drive means within the toy are configured to contact the upper crib rail within the U-shaped channel and move the toy back and forth along the crib rail.

U.S. Pat. No. 4,664,640 issued to Shindo, et al. sets forth a TOY FOR USE WITH INFANT FURNITURE in which an elongated curved track is adapted to be secured to opposing sides of a toy crib. The elongated track thus bridges the space above the infant resting surface. A visually attractive toy member is movably secured to the elongated track and means are provided for moving the amusement member back and forth along the track.

U.S. Pat. No. 4,028,843 issued to Appel sets forth a CHILD'S TOY in which a turtle-shaped frame is provided with a recess and post located within and projecting outwardly from the recess. A plurality of spheres are freely disposed within the recess. A hub is rotatably mounted on the frame post and spaced apart from the recess perimeter to provide a channel within which the balls can be moved. Means are provided for producing an audible sound and for coupling the frame to a crib rail.

U.S. Pat. No. 4,600,399 issued to Abe sets forth a SEQUENTIAL ACTION TOY HAVING A PLURALITY OF CAMS in which a toy includes a housing and drive motor within the housing. A movable member is coupled to the motor via a cam and cam follower arrangement to provide motion thereof. A second movable member is supported upon a elongated support shaft and in turn supports various amusement figures. A second cam and cam follower arrangement provides a variety of motions for the second member and supported amusement figures. An internal central processing unit electronically generates a assortment of musical selections to enhance toy amusement.

U.S. Pat. No. 4,551,114 issued to Hyman, et al. sets forth an IMPACT ACTIVATED TOY FOR USE IN A CHILD'S CRIB. A closed housing supports music generating means together with a momentary push button switch and an impact sensitive switch. The music generating means responds to either the momentary switch or impacts to the toy housing which trip the impact sensitive switch.

U.S. Pat. No. 4,230,317 issued to Breslow, et al. sets forth a SOUND ACTUATED COMPETITIVE GAME APPARATUS in which a skill type game includes a playing area with two goal areas at opposite ends thereof. A sound actuated flipper at each goal is positioned for blocking and returning a playing object. Sounds actuation means are provided for receiving sound commands and actuating the flipper arrangement.

U.S. Pat. No. 4,717,364 issued to Furukawa sets forth a VOICE CONTROLLED TOY in which a voice actuated robot receives commands via a radio transmitter and receiver. Responsive to these commands, the toy robot undertakes a variety of actions. Means are provided for deciphering the incoming messages and determining the commands found therein.

U.S. Pat. No. 3,036,404 issued to Berger sets forth a SOUND CONTROLLABLE TOY in which a doll or toy figure includes means for producing motion within the doll or toy figure together with sound actuating means which respond to received sounds to initiate motion of the doll or toy figure.

U.S. Pat. No. 3,119,201 issued to Brown, et al. sets forth a TOY in which a motor driven toy apparatus is movably supported within a closed housing. A microphone and sound receiving circuit within the housing is coupled to a motor drive unit to activate the motor drive and initiate toy motion upon receipt of acoustic energy.

U.S. Pat. No. 4,637,007 issued to Sakurai sets forth a TOY HAVING A MELODY MAKING MECHANISM OF A SOUND DETECTION TYPE in which a toy such as a stuffed doll includes a melody making mechanism of a sound detection device. The melody making mechanism is provided with a sound detector, an amplifier and a switching circuit in such arrangement that operation of the melody making mechanism may be discontinued after a predetermined period of time. A sound detection means within the toy responds to externally produced sounds to initiate operation of the melody producing mechanism for a predetermined period of time.

U.S. Pat. Nos. 4,453,439 and 3,614,840 and 937,780 set forth additional toy and game devices of general interest to the present invention.

Despite the creation of numerous toys and amusement devices of which the foregoing prior art is exemplary, there remains a continuing need for newer more interesting and more amusing crib toys.

SUMMARY OF THE INVENTION

Accordingly, it is a general object of the present invention to provide an improved crib toy. It is a more particular object of the present invention to provide an improved crib toy which produces enhanced amusement and entertainment value. It is a still more particular object of the present invention to provide an improved crib toy having improved entertainment and amusement value which facilitates skill and response developments of the infant.

In accordance with the present invention, there is provided a crib toy comprises: a housing defining an interior cavity and stage portion; music means for producing music supported within the cavity; sound detecting means producing an activation signal upon receipt of sound; a plurality of figures movably supported upon the stage portion; motion means for moving the figures; trigger means coupled to the sound detecting means, the motion means and the music means causing the music means and the motion means to be operative in response to the activation signal of the sound detecting means; and sound producing activity means, supported upon the housing, for producing sounds capable of causing the sound detecting means to produce an activation signal.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1A:
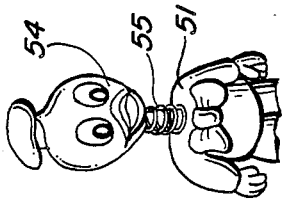
FIGS. 1 and 1A set forth front views of a multiple activation crib toy constructed in accordance with the present invention.
Figure 1:
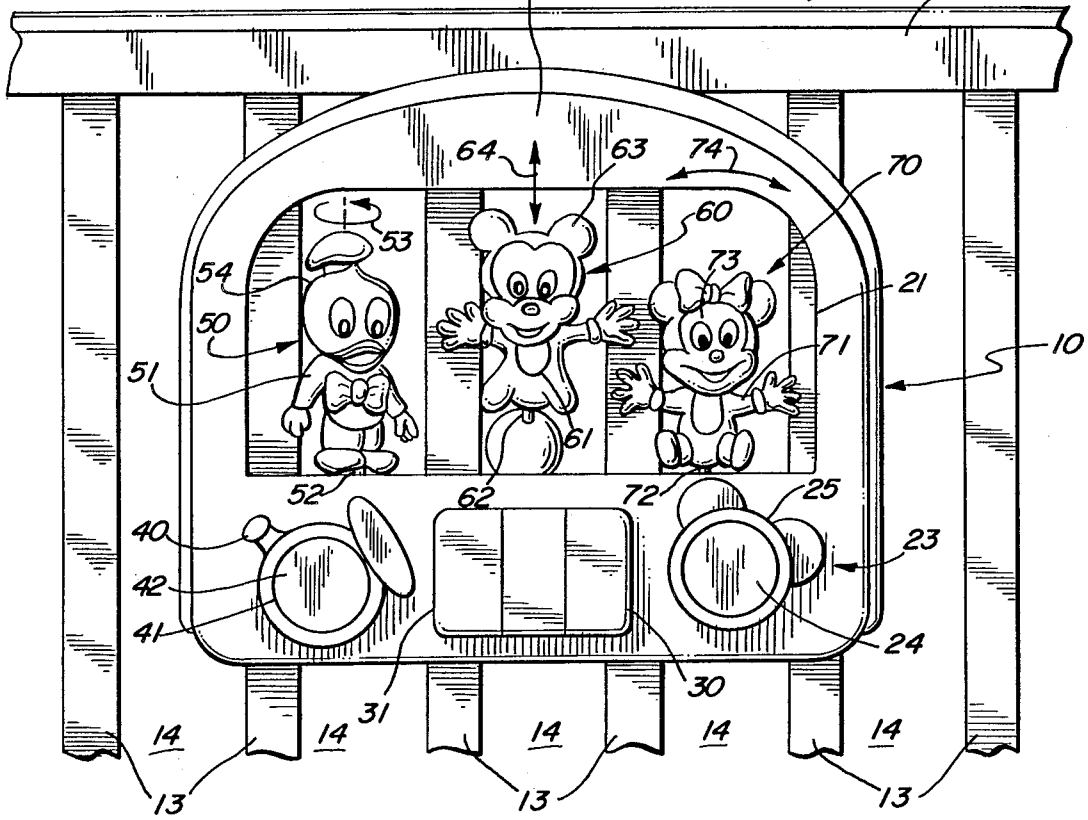

FIG. 1 sets forth a front elevation view of a multiple activation crib toy constructed in accordance with the present invention and generally referenced by numeral 10 supported upon a typical crib generally referenced by numeral 11. Crib 11 may be fabricated in accordance with conventional fabrication techniques and includes a toy rail 12 supporting a plurality of vertical side rails 13. Side rails are spaced to provide an interleaved series of parallel spaces 14. Crib toy 10 includes a unitary housing 20 preferably formed of a molded plastic material and having a hollow construction. Housing 20 further defines a generally rectangular opening 21 extending therethrough and an upper handle portion 22. Handle 22 is configured to provide a convenient carrying handle for the user when toy 10 is not secured to a crib. While housing 20 may be configured in a variety of shapes, it has been found particularly desirable to configure housing 20 and opening 21 such that toy 10 replicates a fanciful theatrical stage environment. Housing 20 further supports a rotatable rattle member 25 which includes an internal cavity and a plurality of rattle elements (not shown) but constructed in accordance with conventional fabrication techniques. Housing 20 further supports a circular mirror 24 about which rattle 25 rotates. Rattle 23 therefore provides a mirrored surface 24 and a movable rattle 25 for child amusement. Housing 20 further defines a generally rectangular aperture 31 within which a depressible button 30 is movably supported. Button 30 is depressible with respect to housing 20 and is coupled to a conventional bell ringing mechanism such that an audible bell sound is produced each time center button 80 is depressed with respect to housing 20. Housing 20 further defines a raised portion 40 replicating a fanciful musical instrument such as a horn and defining a center aperture 41 therethrough. A depressible button 42 is movably supported within aperture 41 and is depressible with respect to housing 20. Button 42 is coupled to a sound producing apparatus which, in its preferred form, comprises a small air bellows and "squeaker" type sound producing device.

A trio of cartoon figures 50, 60 and 70 are supported within opening 21 of housing 20 by a plurality of support linkages 52, 62 and 72 respectively. Specifically, figure 50 replicates a cartoon duck figure and includes a corresponding body portion 51 and a head portion 54. As is better seen in FIG. 1A, head 54 of figure 50 is secured to body 51 by a spring 55. In accordance with drive mechanisms set forth below in FIG. 2 in greater detail, figure 50 is caused to rotate, spin or twirl in the direction indicated by arrow 53 when the motor drive mechanism of the present invention crib toy is activated. Suffice it to here, however, that as figure 50 is twirled or spun about its vertical axis, head 54 is caused to move erratically due to the loose resilient coupling between head 54 and body 51 provided by spring 55.

Figure 60 which is formed to replicate a cartoon figure of a mouse includes a corresponding body 61 and a head portion 63. While not seen in FIG. 1, it should be understood that head 63 is secured to body 61 of figure 60 by a similar spring support mechanism to that shown in FIG. 1A for figure 50. Figure 60 is supported with respect to housing 21 by an upwardly extending support 62.

Figure 2:
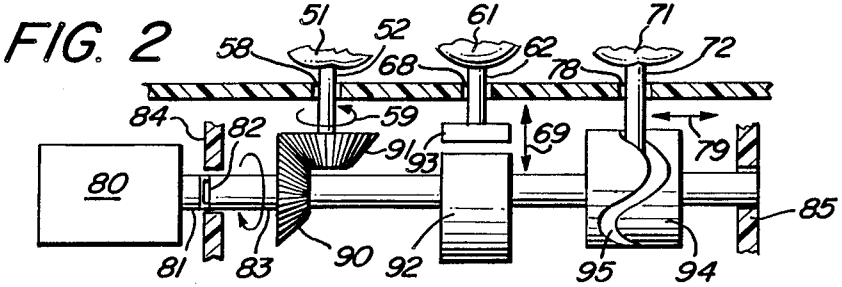
FIG. 2 sets forth a partial section view of the drive mechanism of the present invention crib toy.

A figure 70 is formed to replicate a cartoon figure of a female mouse and includes a body 71 and a head portion 73. Head 78 is secured to body 71 by a similar spring support arrangement to that shown in FIG. 1A for figure 50. A support shaft 72 supports figure 70 within opening 21 of housing 20. In accordance with the operation of drive mechanisms shown below in FIG. 2, figure 60 is moved vertically in an up and down motion in the directions indicated by arrow 64 while figure 70 is moved back and forth in a tilting motion in the direction indicated by arrow 74.

Thus as the present invention crib toy is activated, motor drive means (seen in FIG. 2) cause figure 50 to twirl or spin while figure 60 bounces up and down in a vertical motion and figure 70 tilts back and forth.

Figure 4:
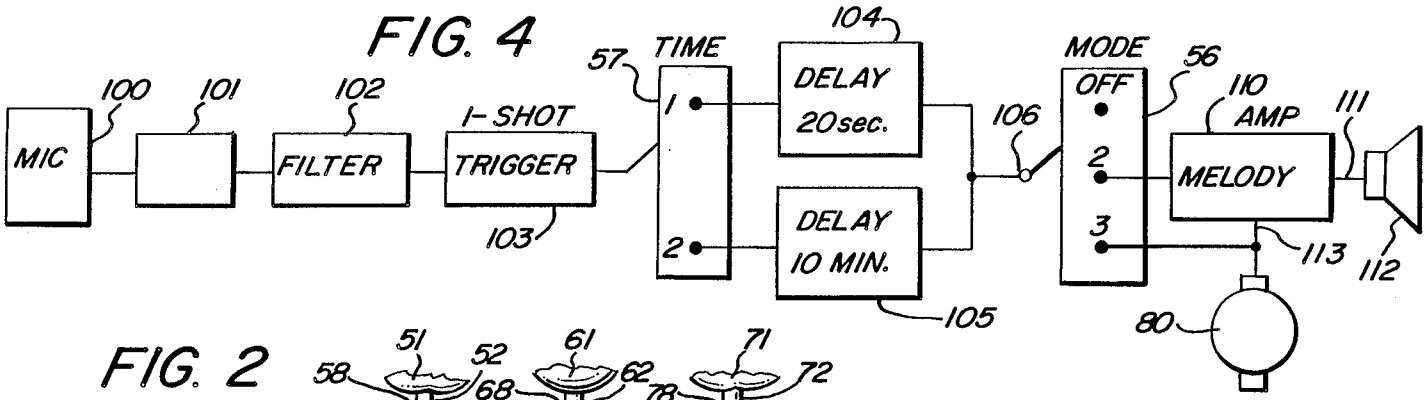
FIG. 4 sets forth a block diagram of the electronic circuit within the present invention multiple activation crib toy.
Figure 5:
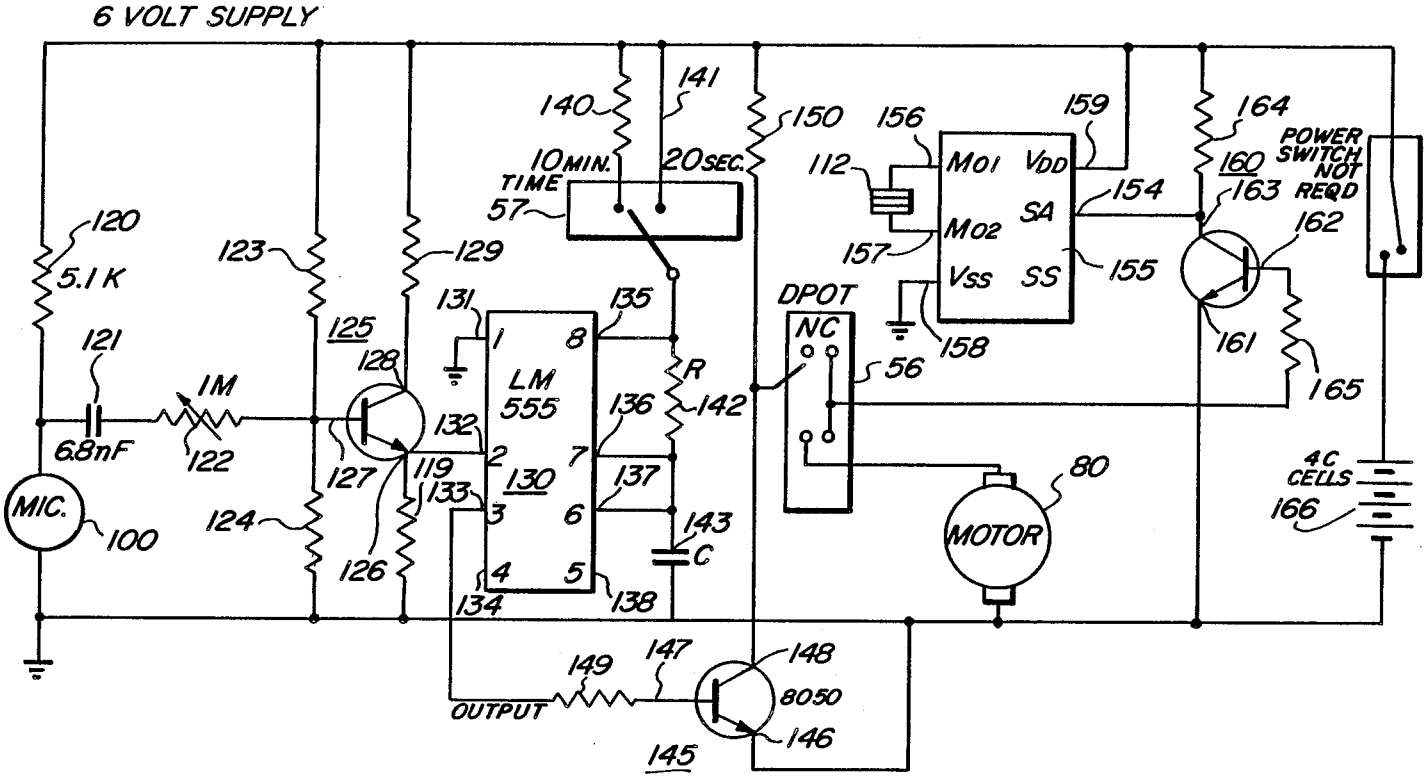
FIG. 5 sets forth a schematic circuit diagram of the electronic circuit of the present invention crib toy.

In accordance with the present invention, housing 20 further supports a microphone 45 which is coupled to internal electronic circuit means shown in FIGS. 4 and 5.

In operation, by means set forth below in greater detail, crib toy 10 is operable in either in two selected modes of operation. In the first mode of operation selected by mode selection switch 56 (seen in FIG. 8) crib figures 50, 60 and 70 remain inoperative during toy activation and the output of crib toy 10 is limited to music. In the second mode of operation also selected by mode switch 56, crib toy 10 produces simultaneous music and motion of figures 50, 60 and 70 as described above.

Turning initially to the operation of crib toy 10 in the first mode of operation, that is music alone, the cycle of operation is initiated by the reception of sound information by microphone 45. While microphone 45 may respond to external noises within the crib environment such as hand clapping or noises generated by the infant user, in accordance with an important aspect of the present invention crib toy 10 is actuated also is response to the noises resulting from the infant's manipulation of rattle 23 or center button 30 or horn button 42 or any combination thereof. Thus, as the infant user manipulates rattle 23, center button 80 and horn button 42 to produce sounds associated therewith, the additional play feature is provided in which music melodies are also produced. Thus, the child experiences not only the direct sound production from its manipulation of rattle 23, center button 30 and horn button 42, but also the related musical melody output. Thus a substantial amusement value and developmental value is added to toy crib 10. In accordance with the operation set forth below in greater detail, the electronic circuitry within housing 20 which produces the musical output is operable for a predetermined time in response to each sound received by microphone 45. By operation of a time duration switch 57 (seen in FIG. 8), the duration of musical sound production occurring in response to each stimulating sound input may be altered. Thus when operated in the first (music only) mode of operation, toy crib 10 produces a predetermined time interval of musical sounds in response to the sounds produced by manual manipulation of rattle 23, center button 30 or horn button 42 or any combination thereof.

In the second mode of operation selected by manipulation of mode switch 56 (seen in FIG. 8), the operation of crib toy 10 is characterized by the simultaneous production of musical sounds described above as well as the above-described motion of figures 50, 60 and 70. Thus, an activation cycle is initiated by the same sound input described above in mode one. In contrast to mode one, however, the production of music for the predetermined interval is accompanied by the energizing of the system's drive motor (seen in FIG. 2) to provide simultaneous motion of figures 50, 60 and 70. As described above, support 52 is rotated in the direction indicated by arrow 53 causing figure 50 to correspondingly rotate. In addition, the spring coupling between head 54 and body 51 permits head 54 to wobble or undergo other erratic motion to further enhance the entertainment and amusement value of figure 50's motion. Concurrently, support 62 is activated by the system's motor drive means in the manner described in FIG. 2 to provide a bouncing vertical motion in the direction indicated by arrows 64 for figure 60. Once again, the spring coupling between head 63 and body 61 permits figure 50 to undergo additional erratic and more entertaining motion. Finally, support 72 is manipulated in a tilting fashion in the manner shown in FIG. 2 to provide a swaying or back and forth tilting motion of figure 70 in the directions indicated by arrows 74. Once again, the spring coupling between head 73 and body 71 produces additional entertaining motion of figure 70. The collective action and motions of figures 50, 60 and 70 within opening 21 together with the accompanying music produced by the present invention crib toys internal music system provide considerable activity and amusement for the infant's enjoyment. In addition, the discovery of and manipulation of the relationship between the infant's manipulation of sound producing devices such as rattle 23, center button 30 and horn button 42 and the accompanying music and figure motion provide considerable amusement and developmental experience for the infant user.

FIG. 2 sets forth the figure drive mechanism of the present invention crib toy. A motor 80 constructed in accordance with conventional fabrication techniques includes an output shaft 81. A drive shaft 88 is supported within housing 20 by a support 84 and a support 85 such that drive shaft 88 is rotatable therein. A coupling 82 extends between drive shaft 88 and output shaft 81 of motor 80. Drive shaft 83 supports an elongated eccentric cam 92 and a generally cylindrical drum 94. Drum 94 defines a zigzag slot 95 extending continuously about the surface of drum 94. Thus as drive shaft 83 is rotated under the power produced by motor 80, bevel gear 90 is correspondingly rotated while cam 92 rotates to provide eccentric motion thereof and drum 94 rotates. As described above, support 52 provides the support for body 51 and extends downwardly through aperture 58 of housing 20. Support 52 terminates in a bevel gear 91 which engages bevel gear 90. Thus, rotation of bevel gear 90 caused by rotation of drive shaft 83 produces the above-described rotation of support 52 through the engagement of bevel gears 90 and 91. Support 62 provides the support for body 61 of figure 60 and extends downwardly through housing 20 via an aperture 68 defined therein. Support 62 terminates in a cam follower 93 which is supported by and in contact with cam 92. Thus as cam 92 is rotated due to the rotation of drive shaft 93, cam follower 93 is driven up and down in a vertical reciprocating motion in the directions indicated by arrow 69 which in turn raises and lowers body 61 of figure 60. Support 72 provides the support for body 71 of figure 70 and extends downwardly through an aperture 78 in housing 20 to be received within slot 95 of drum 94. Because the end portion of support 72 is captivated within slot 95, the rotation of drum 94 caused by the rotation of drive shaft 883 causes the lower end of support 72 to follow the zigzag motion of slot 95. As a result, support 72 is tilted back and forth in the directions indicated by arrows 79 to provide the above-described tilting motion of figure 70. Thus, it will be apparent from examination of FIG. 2 that a single drive motor 80 and a relatively straight forward mechanical coupling mechanism provides the simultaneous motions of figure 50, 60 and 70 such that each figure undergoes its unique characteristic motion.

Figure 3:
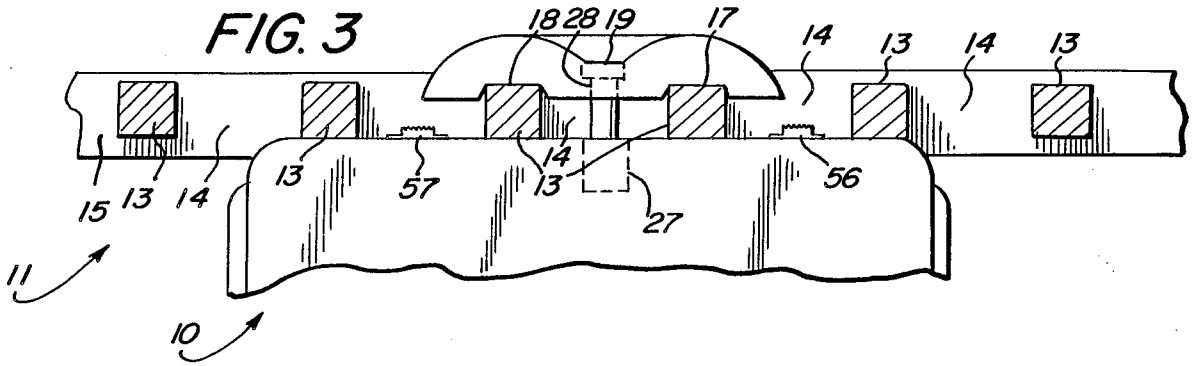
FIG. 3 sets forth a partial section view of the present invention multiple activation crib toy seen from above.

FIG. 8 sets forth a partially sectioned toy view of toy crib 10 supported by crib 11. As described above, crib 11 includes a plurality of parallel generally equally spaced side rails 13 having interleaved spacings 14 therebetween. A bottom rail 15 is secured to the lower ends of side rails 13 to provide support therefor. Housing 20 of toy crib 10 defines a generally planar rear surface 26 which supports a mode switch 56 and a duration switch 57. In their simplest form, switches 56 and 57 comprise conventional multiposition slide switches. However, it will be apparent to those skilled in the art that any number of switch types may be used for switches 56 and 57. A clamp support 16 defines a generally elongated member having a pair of vertical channels 17 and 18 extending therethrough. Clamp support 16 further defines a center aperture 28 which in turn supports an elongated bolt 19 extending therethrough. Housing 20 defines a threaded aperture 27 sized to threadably receive bolt 19. Thus in the assembly shown in FIG. 2, housing 20 is positioned on the interior of crib 11 while clamp support 16 is positioned in an opposed position on the opposite side of side rails 13. Bolt 19 is passed through aperture 28 and is threadably received within threaded aperture 27 of housing 20. The threaded engagement of bolt 19 to housing 20 captivates a pair of side rails 13 between rear surface 26 of housing 20 and clamp support 16 to reliably secure housing 20 to side rails 13 in a fixed position. While the clamping mechanism shown in FIG. 3 to secure housing 20 to crib 11 has been found advantageous, it will be apparent to those skilled in the art that other equivalent clamping forms may be used to support housing 20 without departing from the spirit and scope of the present invention.

FIG. 4 sets forth a block diagram of the electronic circuit means within toy crib 10. A microphone 100 includes conventional transducer means for converting a received acoustic signal to an electrical signal which is coupled to a threshold amplifier 101. The output of threshold amplifier 101 is coupled through a filter 102 to a trigger circuit 103. A duration switch 57 alternatively couples the output of trigger circuit 103 to a delay circuit 104 or a delay circuit 105 which are parallelly coupled to duration switch 57 and a common output coupling 106. Coupling 106 is coupled to a mode selection switch 66 which alternatively provides no connection, connection solely to a melody producing circuit 110, or simultaneous coupling to melody circuit 110 and a motor 80. The output of melody circuit 110 is coupled via an output connection Ill to an output transducer 112.

In operation, sound energy received by microphone 100 such as that produced above by the manipulation of rattle 23, center button 30 or horn button 42 or alternatively some external sound source produces a corresponding electrical signal which is applied to threshold amplifier 101. Threshold amplifier 101 is operative to couple the received signal to filter 102 once the received signal exceeds a predetermined threshold. Should the threshold of circuit 101 be exceeded, that is to say should the received sound be of sufficient volume, the output signal of threshold circuit 101 is filtered by filter 102 and applied to the trigger input of trigger circuit 103. Filter 102 functions to exclude short duration erratic noise information and avoid false triggering of trigger circuit 103. Trigger circuit 103 may comprise a monostable multivibrator or other one shot type circuit which responds to the input signal from filter 102 to produce a reliable output signal for use in activating either circuit 104 or 105 in accordance with the switch setting position of switch 57. Circuits 104 and 105 differ only in the duration of output signal they produce. Thus with the position of duration switch 57 in the manner shown in FIG. 4, the output signal of trigger circuit 103 is applied to delay circuit 104 which produces an output signal at coupling 106 for a predetermined period of time. This output signal is applied to mode selection switch 56. In the event mode selection switch 56 is positioned in the manner shown in FIG. 4, no connection is made to either melody circuit 110 or motor 80. Thus, despite the occurrence of an unabling signal, no activity of crib toy 10 is initiated In the event mode selection switch 56 is positioned to terminal two thereof, the occurrence of an output signal from circuit 104 is applied solely to melody circuit 110 which produces an output music signal which is applied to output transducer 112 to provide audible music. By further alternative, in the event mode selection switch 56 is applied to position three thereof, the occurrence of output signal at coupling 108 simultaneously energizes motor 80 and melody circuit 110. The simultaneous energizing of melody circuit 110 and motor 80 produces simultaneous music output and motion of figures 50, 60 and 70 as set fort h above in FIG. 1.

In the event duration switch 57 is positioned alternatively in position two thereof, the output signal of trigger circuit 103 is alternatively coupled to delay circuit 105 which in turn produces an output signal at coupling 106 having a different duration than that of circuit 104. As a result, the above-described operation is carried forward in accordance with the position of mode selection switch 56 for a different time period.

FIG. 5 sets forth a schematic circuit diagram of the electronic circuit of the present invention crib toy. A microphone 100 is coupled to ground and to a source of operating supply by a resistor 120. A transistor 125 includes an emitter electrode 126 coupled to ground by a resistor 119, a base electrode 127 coupled to ground by a resistor 124 and to operating supply by a resistor 123, and a collector electrode 128 coupled to a source of operating supply by a resistor 129. A series combination of a capacitor 121 and a variable resistor 122 is coupled between microphone 100 and base electrode 127. An integrated circuit 130 comprising a conventional LM555 integrated circuit includes a connection 131 coupled to ground, a connection 132 coupled to emitter 126, a connection 133, a connection 134, a connection 135 coupled to duration switch 57, a connection 136 coupled to connection 135 by a resistor 142, a connection 137 coupled to connection 136 and to ground by a capacitor 143 and a connection 138. Connections 134 and 138 remain unconnected. To facilitate understanding of the configuration of integrated circuit 130, the corresponding terminal numbers found on the LM555 package are also designated in the drawing shown. A transistor 145 includes an emitter electrode 146 coupled to ground, a base electrode 147 coupled to connection 133 by a resistor 149 and a collector electrode 148 coupled to operating supply by a resistor 150. Collector electrode 146 is also coupled to mode switch 56. A motor 180 is coupled between ground and mode switch 56. A transistor 160 includes an emitter electrode 161 coupled to ground, a base electrode 165 coupled to mode switch 56 and a collector electrode 163 coupled to operating supply by a resistor 164. The series combination of a battery cell combination 166 and a power switch 167 are coupled between ground and the operating supply terminal of the circuit of FIG. 5. An integrated circuit 155 having a device number LM 55 includes a pair of output terminals 156 and 157 coupled to transducer 112 and a ground terminal 158 coupled to ground. Integrated circuit 155 further includes a supply terminal 159 coupled to a source of operating supply and an input terminal 154 coupled to collector electrode 163 of transistor 160.

In operation, audible sounds received by microphone 100 are converted thereby to a corresponding electrical signal which is coupled by the series combination of capacitor 121 and potentiometer 122 to the base electrode of transistor 125. The combination of resistors 123 and 124 establishes bias voltage for transistor 125 which maintains transistor 125 nonconductive until the input signal from microphone 100 exceeds the bias voltage at base 127. Thereafter, the signal at base 127 is coupled by transistor 125 to terminal 132 of integrated circuit 130.

Integrated circuit 130 produces an output signal at terminal 183, the time duration of which is determined by the position of time duration switch 57. In essence, time duration switch 57 varies the time constant of the network applied to integrated circuit 130 and thus controls the duration of output signal at terminal 133. The output signal at terminal 133 is coupled to transistor 145 and causes conduction thereof during the duration of signal applied. The conduction of transistor 145 produces an output signal at collector 148 which is applied to the remainder of the system in accordance with the setting of mode switch 56. In the event mode switch 56 is set in the manner shown in FIG. 5, no connection is made to the remainder of the circuit of FIG. 5 and no discernible output is produced. Alternatively, in the event mode switch 56 is set to the music only position, the output signal at collector 148 is applied to transistor 160 which produces a corresponding conduction thereof. The conduction of transistor 160 enables music integrated circuit 155 causing an audio output at transducer 112 producing audible music. In the event mode switch 56 is set to the music and motion position, the output signal at collector 148 is also then simultaneously applied to motor 80 energizing motor 80 and producing the above-described motion of figures 50, 60 and 70 (seen in FIG. 1).

What has been shown, therefore, is a novel multiple actuation crib toy in which the sounds produced by the crib toy itself may be processed to trigger the activities of the crib toy. There is provided, therefore, the additional aspect heretofore unrealized in such crib toys in which the developmental activity to which the child user is subjected includes the direct relationship between the sounds produced by the child user's manipulations of the sound producing apparatus of the crib toy and the sound and motion produced by the music generation system and mechanical figure motion system of the crib toy.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A crib toy comprising:

a housing defining an interior cavity and stage portion;

music means for producing music supported within said cavity;

sound detecting means producing an activation signal upon receipt of sound;

a plurality of figures movably supported upon said stage portion;

motion means for moving said figures;

trigger means coupled to said sound detecting means, said motion means and said music means causing said music means and said motion means to be operative in response to said activation signal of said sound detecting means; and sound producing activity means, supported upon said housing, for producing sounds capable of causing said sound detecting means to produce an activation signal.

2. A crib toy as set forth in claim 1 wherein said trigger means includes a mode selection switch having a first mode in which said motion means remain inoperative and a second mode in which said motion means and said music means are simultaneously operative.

3. A crib toy as set forth in claim 2 wherein said trigger means include a time duration selection switch for altering the duration of operation of said motion means and said music means.

4. A crib toy as set forth in claim 1 wherein said motion means provide different motions for each of said figures.

5. A crib toy as set forth in claim 4 wherein said sound producing activity means include a plurality of movable elements supported upon said housing configured for manipulation by an infant.

6. A crib toy as set forth in claim 5 wherein said sound producing activity means include a bell, a rattle and a squeaker.

7. A crib toy as set forth in claim 1 wherein said housing includes clamp means for securing said housing to a crib.

* * * * *